US012262771B2

(12) United States Patent
Böck et al.

(10) Patent No.: US 12,262,771 B2
(45) Date of Patent: Apr. 1, 2025

(54) FASHION ARTICLE OR TEXTILE ARTICLE WITH MAGNETICALLY ATTACHABLE PATCH ELEMENT

(71) Applicant: NEXT GENERATION HEADWEAR GMBH, Graz (AT)

(72) Inventors: Robert Böck, Graz (AT); Peter Brunner, Graz (AT)

(73) Assignee: NEXT GENERATION HEADWEAR GMBH, Graz (AT)

( * ) Notice: Subject to any disclaimer, the term of this patent is extended or adjusted under 35 U.S.C. 154(b) by 29 days.

(21) Appl. No.: 18/012,527

(22) PCT Filed: Jun. 25, 2020

(86) PCT No.: PCT/EP2020/067929
§ 371 (c)(1),
(2) Date: Dec. 22, 2022

(87) PCT Pub. No.: WO2021/259486
PCT Pub. Date: Dec. 30, 2021

(65) Prior Publication Data

US 2023/0263254 A1 Aug. 24, 2023

(51) Int. Cl.

| | |
|---|---|
| ***A42B 1/248*** | (2021.01) |
| ***A41D 27/08*** | (2006.01) |
| ***A44B 17/00*** | (2006.01) |

(52) U.S. Cl.
CPC ..... *A42B 1/248* (2013.01); *A41D 27/08* (2013.01); *A44B 17/00* (2013.01); *A44D 2203/00* (2013.01)

(58) Field of Classification Search
CPC ..... A42B 1/24; A42B 1/248
See application file for complete search history.

(56) References Cited

U.S. PATENT DOCUMENTS

| | | | | |
|---|---|---|---|---|
| 5,740,557 | A * | 4/1998 | Reid | A42B 1/248 2/244 |
| 6,175,963 | B1 * | 1/2001 | Loeffelholz | A43B 23/24 2/200.1 |
| 6,519,779 | B1 * | 2/2003 | Taguchi | A42B 1/248 2/209.12 |
| 7,243,377 | B2 * | 7/2007 | Ashy | A42B 1/248 40/329 |
| 7,490,364 | B2 * | 2/2009 | Kim | A42B 1/248 40/329 |
| 9,936,752 | B2 * | 4/2018 | Calvert | A41F 1/002 |
| 2006/0137076 | A1 | 6/2006 | Vaughn et al. | |
| 2007/0028361 | A1 | 2/2007 | Ashy | |
| 2010/0058511 | A1 * | 3/2010 | Lee | A41D 27/085 2/244 |
| 2012/0005809 | A1 * | 1/2012 | Johnson | A42B 1/248 2/209.13 |
| 2018/0042325 | A1 * | 2/2018 | Regan | A45F 3/04 |

(Continued)

*Primary Examiner* — Jillian K Pierorazio
(74) *Attorney, Agent, or Firm* — Procopio, Cory, Hargreaves & Savitch LLP

(57) ABSTRACT

The present disclosure relates to a fashion article or textile article, such as a cap 100, with a magnetically attachable and/or detachable patch element 200. Furthermore, the present disclosure relates to a patch element 200 magnetically attachable to the textile article or fashion article, such as the cap 100, and to a textile article or fashion article, such as the cap 100, configured to magnetically attach the magnetically attachable patch element 200.

13 Claims, 10 Drawing Sheets

(56) References Cited

U.S. PATENT DOCUMENTS

| | | | | |
|---|---|---|---|---|
| 2018/0206575 | A1* | 7/2018 | Dotzenrod | A47G 23/0266 |
| 2019/0298025 | A1* | 10/2019 | Farghal | A45C 13/08 |
| 2020/0404997 | A1* | 12/2020 | Davis | A42B 1/0186 |
| 2021/0386152 | A1* | 12/2021 | Jackson | A42B 1/24 |

* cited by examiner

FASHION ARTICLE OR TEXTILE ARTICLE WITH MAGNETICALLY ATTACHABLE PATCH ELEMENT

CROSS-REFERENCE TO RELATED APPLICATIONS

This application is US National Stage of International Patent Application PCT/EP2020/067929, filed Jun. 25, 2020, the contents of which are incorporated herein by reference.

DESCRIPTION

The present disclosure relates to a textile article or fashion article, such as e.g. articles of clothing, headwear or shoes, the article being configured to magnetically attach a magnetically attachable patch element. Furthermore, the present disclosure relates to a patch element magnetically attachable to and/or detachable from a textile article or fashion article and to a textile article or fashion article with a magnetically attachable and/or detachable patch element.

BACKGROUND

In the prior art, it is known to provide labels and patches attachable to fashion articles such as articles of clothing or headwear.

For example, US 2006/137076 A1 relates to interchangeable labels and patches made with the positive or negative side of magnets and/or Velcro permanently affixed to the article of clothing and the opposite side of the magnet and/or Velcro permanently affixed to the back of the label and/or patch so that the consumer can switch labels and/or patches with other labels and/or patches.

U.S. Pat. No. 6,175,963 B1 relates to a system for detachably securing emblems, or the like, to articles of clothing, such as caps, hats, shirts, jackets, belts, and shoes. The system employs the combination of two magnetically attractive elements, for example, a magnet and a plate or a piece of ferromagnetic material. One or more magnets or pieces of the ferromagnetic material may be embedded in or adhesively attached to the clothing. Similarly, one or more magnets or pieces of the ferromagnetic material may be embedded in or attached to one or more emblems. The emblems are placed over selected ones of the magnetically attractive elements in the clothing, and thereby magnetically secured thereto.

US 2007/028361 A1 relates to a wearable hat that contains an interchangeable advertising media location positioned on an exterior portion thereof. The interchangeable advertising media location is generally configured to receive an advertising media logo that may be quickly and easily removed and replaced with a different advertising media logo. The respective advertising media logos may be removable secured to the advertising media location via magnetic securing means, hook and loop fasteners, or other means of removably securing an advertising object to an article of clothing.

However, in such attachment systems or the prior art, it is difficult to accurately and correctly attach the patch elements quickly and efficiently and at the same time in the correct position and orientation. Also, it is difficult to accurately and correctly attach the patch elements of different sizes and/or shapes.

It is an object of the present disclosure to provide an improved mechanism for detachably attaching a patch element to a fashion article.

In particular, it is an object of the present disclosure to preferably provide an improved attachment mechanism allowing the user of the fashion article to accurately and correctly attach patch elements quickly and efficiently and at the same time in the correct position and orientation.

In particular, it is an object of the present disclosure to preferably provide an improved attachment mechanism allowing the user of the fashion article to accurately and correctly attach the patch elements of different sizes and/or shapes.

SUMMARY

In view of one or more of the above objects, there are proposed: a textile article or fashion article configured to magnetically attach one or more magnetically attachable patch elements onto an outer face portion of the article, one or more patch elements magnetically attachable to and/or detachable from a textile article or fashion article, and a textile article or fashion article with a magnetically attachable and/or detachable patch element according to the independent claims. Dependent claims relate to exemplary preferred embodiments.

Exemplary embodiments may be provided in connection with textile articles or fashion articles such as e.g. articles of clothing (e.g. shirts, sweaters, hoodies, T-shirts, sweatshirts, pullovers, trousers, jackets, coats, belts, scarfs, vests, suits, skirts, dresses, headbands, wristbands, etc.), shoes or other headwear (e.g. hats, beanies, bonnets, helmets, etc.) or even other fashion articles (e.g. bags, handbags, travel bags, backpacks, toiletry bags, gym bags, wallets, umbrellas, blankets, etc.). In some exemplary aspects, the magnetic attachment portion may be provided at or below an outer face layer of a textile article (i.e. an article including textile material and/or at least one textile layer), such as any of the above articles or others, such as e.g. articles of furniture, e.g. with textile outer faces), such as e.g. chairs, armchairs, sofas, beds, curtains, cushions, pillows, or also further articles with layered or flexible outer face portions such as e.g. tents, etc.

In accordance with an aspect of the present disclosure, there is proposed a textile article or fashion article comprising an outer face portion and a magnetic attachment portion, which may, in some exemplary aspects, be covered by the outer face portion and/or be attached to the outer face portion and/or be arranged at an inner side of the outer face portion (e.g., embedded within/between layers of a layered material which may include one or more textile layers).

According to exemplary preferred aspects, the magnetic attachment portion may preferably be configured for detachable magnetic attachment of one or more magnetically attachable patch elements to the outer face portion of the article.

According to exemplary preferred aspects, each magnetically attachable patch element may include a plurality of magnets arranged according to a respective pre-determined pattern (in particular a two-dimensional magnet pattern).

The patch element may include one or more flexible layers (layered material), and the magnets arranged according to the respective pre-determined pattern may be arranged between a pair of the layers of plural layers of the patch element, e.g. textile layers.

According to exemplary preferred aspects, the magnetic attachment portion may include plural magnet elements arranged according to a pre-determined pattern arrangement (in particular a two-dimensional magnet pattern arrangement) which includes one or more magnet patterns (in particular a two-dimensional magnet patterns).

According to exemplary preferred aspects, each magnet pattern of the pattern arrangement of the magnetic attachment portion may correspond to a respective one of the pre-determined patterns of the one or more magnetically attachable patch elements.

For example, each magnet pattern of the pattern arrangement of the magnetic attachment portion may identically correspond to a respective one of the pre-determined patterns of the one or more magnetically attachable patch elements, e.g. in that the magnets of the respective magnet pattern of the pattern arrangement of the magnetic attachment portion may be arranged according to a same two-dimensional pattern layout as the corresponding respective one of the pre-determined patterns of the one or more magnetically attachable patch elements (preferably however with opposing polarities).

According to exemplary preferred aspects, the magnetic attachment portion may be configured for detachable magnetic attachment of a magnetically attachable patch element of a first type (first layout), the magnetically attachable patch element of the first type preferably including a plurality of magnets arranged according to a respective first-type pattern (first layout arrangement).

According to exemplary preferred aspects, the pattern arrangement of the magnetic attachment portion may include plural magnets arranged corresponding to the first-type pattern.

According to exemplary preferred aspects, the magnetic attachment portion may be configured for detachable magnetic attachment of a magnetically attachable patch element of a second type (second layout), the magnetically attachable patch element of the second type including a plurality of magnets arranged according to a respective second-type pattern (second layout arrangement).

According to exemplary preferred aspects, the pattern arrangement of the magnetic attachment portion may include plural magnets arranged corresponding to the second-type pattern.

According to exemplary preferred aspects, at least one of the magnets of the magnetic attachment portion is included in the first-type pattern and the second-type pattern. That is, the first-type patter and second-type pattern may share or more magnets of the magnet pattern arrangement.

According to exemplary preferred aspects, the at least one of the magnets of the magnetic attachment portion being included in the first-type pattern and the second-type pattern may be arranged in a center portion of the pattern arrangement.

According to exemplary preferred aspects, the first-type pattern and the second-type pattern are different (e.g. different shapes of arrangement, different distances between magnets, different polarities, and/or different magnet positions).

According to exemplary preferred aspects, the magnetically attachable patch element of the first type and the magnetically attachable patch element of the second type have different shapes and/or different sizes.

According to exemplary preferred aspects, the first-type pattern has an arrangement of magnets in accordance with a size and/or shape of the magnetically attachable patch element of the first type.

According to exemplary preferred aspects, the second-type pattern has an arrangement of magnets in accordance with a size and/or shape of the magnetically attachable patch element of the second type.

According to exemplary preferred aspects, the magnetically attachable patch element of the first type has an angular shape including three or more corners and the first-type pattern has an arrangement of magnets in accordance with the angular shape of the magnetically attachable patch element of the first type and includes at least one magnet for each corner of the angular shape of the magnetically attachable patch element.

According to exemplary preferred aspects, the magnetically attachable patch element of the second type has an angular shape including three or more corners and the second-type pattern has an arrangement of magnets in accordance with the angular shape of the magnetically attachable patch element of the second type and includes at least one magnet for each corner of the angular shape of the magnetically attachable patch element.

According to exemplary preferred aspects, the first-type pattern has an arrangement of at least three magnets arranged around a center portion of the pattern arrangement.

According to exemplary preferred aspects, the second-type pattern has an arrangement of at least three magnets (preferably four or more magnets) arranged around a center portion of the pattern arrangement.

According to exemplary preferred aspects, two or more magnets of the magnetic attachment portion are included in the first-type pattern and not included in the second-type pattern.

According to exemplary preferred aspects, two or more magnets of the magnetic attachment portion are included in the second-type pattern and not included in the first-type pattern.

According to exemplary preferred aspects, the two or more magnets of the magnetic attachment portion included in the first-type pattern and not included in the second-type pattern have opposite polarity compared to the two or more magnets of the magnetic attachment portion included in the second-type pattern and not included in the first-type pattern.

According to exemplary preferred aspects, the magnets of the magnetically attachable patch element are held according to the pre-determined pattern between at least two foils, in particular at least two heat-pressed foils.

According to exemplary preferred aspects, the at least two foils may be embedded between at least two layers of fabric.

According to exemplary preferred aspects, the magnets of the magnetic attachment portion of the article are held according to the pre-determined pattern arrangement between at least two foils, in particular at least two heat-pressed foils.

According to exemplary preferred aspects, the at least two foils may be embedded between at least two layers of fabric.

According to exemplary preferred aspects, the article may further include the one or more magnetically attachable patch elements.

In view of the above, according to an independent aspect, there may also be provided a magnetic attachment portion including two layers, such as e.g. two foils, and a plurality of magnets arranged and held between the two layers according to a pre-determined magnet pattern (in particular two-dimensional magnet pattern) or according to a pre-determined magnet pattern arrangement including one or more pre-determined magnet patterns (in particular two-dimensional magnet patterns). The layers may include foils, in particular heat-pressed foils, preferably with the magnets being held between the heat-pressed foils. The magnetic attachment portion may be configured to be sewed and/or glued to or between layers, such as textile layers of a textile article or fashion article (e.g. to provide the patch element or to provide the outer face portion of an article according to at least one of the above aspects.

According to another aspect, there is proposed a magnetically attachable patch element configured for detachable magnetic attachment to an outer face portion of an article according to at least one of the above aspects.

According to exemplary preferred aspects, the magnetically attachable patch element may include a front layer, in particular including fabric, a back layer, in particular including fabric, and/or a magnet patch layer which may preferably be arranged between the front and back layers, and/or the magnet patch layer may include a plurality of magnets arranged according to a respective pre-determined pattern.

According to further aspects, there may be proposed a method of attaching a patch element to an article, in particular an article according to one of the above aspects. The method may include: attaching one of the one or more patch elements to the outer face portion; for example, by aligning the patch element with a position of the magnetic attachment portion, and/or engaging and/or aligning each magnet of the pre-determined pattern of the respective patch element with its corresponding magnet (preferably with opposing polarity) of the pre-determined pattern arrangement of the magnetic attachment portion.

While certain exemplary aspects have been described above, it is to be understood that such aspects are merely illustrative of (and are not to be understood restrictive on) the broad invention and present disclosure, and that the exemplary aspects are not limited to the specific constructions and arrangements shown and described above or below, since various other changes, combinations, omissions, modifications and substitutions, in addition to those set forth in the above or below description, are possible. Those skilled in the art will appreciate that various adaptations, modifications, and/or combination of the just described aspects can be configured or be provided. Therefore, it is to be understood that further aspects may be practiced other than as specifically described herein. For example, unless expressly stated otherwise, the steps of processes described herein may be performed in orders different from those described herein and one or more steps may be combined, split, or performed simultaneously. Those skilled in the art will also appreciate, in view of this disclosure, that different aspects described herein may be combined to form other aspects of the present disclosure.

DETAILED DESCRIPTION OF THE DRAWINGS AND EXEMPLARY EMBODIMENTS

Figure 1A:
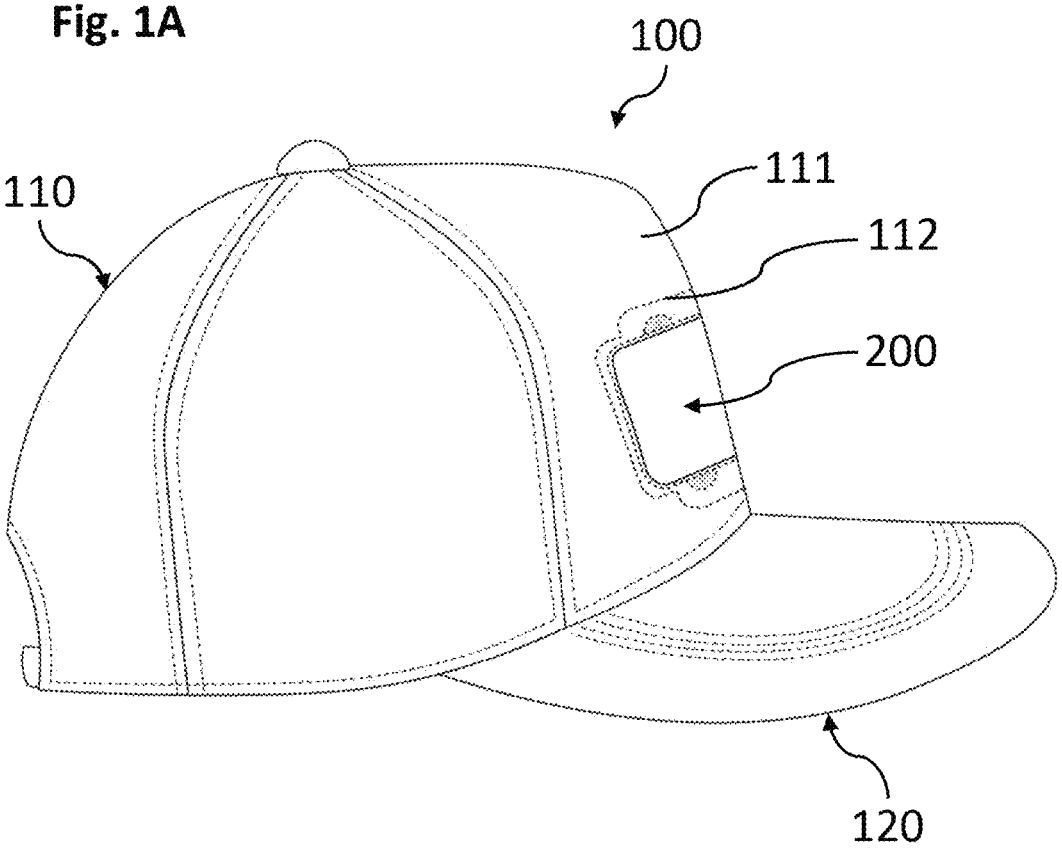
FIG. 1A exemplarily shows a schematic side view of a wearable cap with a magnetically attachable patch according to exemplary embodiments, FIG. 1B exemplarily shows a schematic front view of a wearable cap with the magnetically attachable patch according to FIG. 1A, FIG. 1C exemplarily shows a schematic front view of a wearable cap with the exemplarily partially removed magnetically attachable patch according to FIG. 1A, FIG. 2 exemplarily shows a schematic front view of a wearable cap according to FIGS. 1A to 1C exemplarily without the magnetically attachable patch, FIG. 3A exemplarily shows a schematic front view of a magnetically attachable patch according to exemplary embodiments, FIG. 3B exemplarily shows a schematic view of a magnet patch layer of a magnetically attachable patch according to FIG. 3A, FIG. 3C exemplarily shows a schematic explosive view of a magnetically attachable patch according to FIG. 3A, FIG. 4A exemplarily shows a schematic side view of a wearable cap with a magnetically attachable patch according to other exemplary embodiments, FIG. 4B exemplarily shows a schematic front view of a wearable cap with the magnetically attachable patch according to FIG. 4A, FIG. 4C exemplarily shows a schematic front view of a wearable cap with the exemplarily partially removed magnetically attachable patch according to FIG. 4A, FIG. 5A exemplarily shows a schematic front view of a magnetically attachable patch according to other exemplary embodiments, FIG. 5B exemplarily shows a schematic view of a magnet patch layer of a magnetically attachable patch according to FIG. 5A, FIG. 5C exemplarily shows a schematic explosive view of a magnetically attachable patch according to FIG. 5A, FIG. 6A exemplarily shows a schematic view of a magnet patch layer of a wearable cap according to exemplary embodiments, FIG. 6B exemplarily shows a schematic view of a first-type magnet patch layer of a magnetically attachable patch exemplarily adapted to the magnet patch layer of FIG. 6A, FIG. 6C exemplarily shows a schematic view of a second-type magnet patch layer of a magnetically attachable patch exemplarily adapted to the magnet patch layer of FIG. 6A, FIG. 7A exemplarily shows a schematic view of a magnet patch layer of a wearable cap according to other exemplary embodiments, FIG. 7B exemplarily shows a schematic view of a first-type magnet patch layer of a magnetically attachable patch exemplarily adapted to the magnet patch layer of FIG. 7A, FIG. 7C exemplarily shows a schematic view of a second-type magnet patch layer of a magnetically attachable patch exemplarily adapted to the magnet patch layer of FIG. 7A, FIG. 8A exemplarily shows a schematic view of a magnet patch layer of a wearable cap according to yet another exemplary embodiments, FIG. 8B exemplarily shows a schematic view of a first-type magnet patch layer of a magnetically attachable patch exemplarily adapted to the magnet patch layer of FIG. 8A, and FIG. 8C exemplarily shows a schematic view of a second-type magnet patch layer of a magnetically attachable patch exemplarily adapted to the magnet patch layer of FIG. 8A.

In the following, preferred exemplary aspects and exemplary embodiments of the present invention will be described in more detail with reference to the accompanying figures. Same or similar features in different drawings and exemplary embodiments are referred to by similar reference numerals. It is to be understood that the detailed description below relating to various preferred exemplary aspects and preferred exemplary embodiments are not to be meant as limiting the scope of the present invention. Specifically, while the below exemplary embodiments are exemplarily described in relation to an article of headwear, in particular exemplarily in relation to a wearable cap, it is to be understood that the invention is not limited to headwear or wearable caps, and further exemplary embodiments may be provided in connection with other fashion articles such as e.g. articles of clothing (e.g. shirts, sweaters, hoodies, T-shirts, sweatshirts, pullovers, trousers, jackets, coats, belts, scarfs, vests, suits, skirts, dresses, headbands, wristbands, etc.), shoes or other headwear (e.g. hats, beanies, bonnets, helmets, etc.) or even other fashion articles (e.g. bags, handbags, travel bags, backpacks, toiletry bags, gym bags, wallets, umbrellas, blankets, etc.). In some exemplary aspects, the magnetic attachment portion may be provided at or below an outer face layer of a textile article (i.e. an article including textile material and/or at least one textile layer), such as any of the above articles or others, such as e.g. articles of furniture, e.g. with textile outer faces), such as e.g. chairs, armchairs, sofas, beds, curtains, cushions, pillows, or also further articles with layered or flexible outer face portions such as e.g. tents, etc.

Figure 1B:
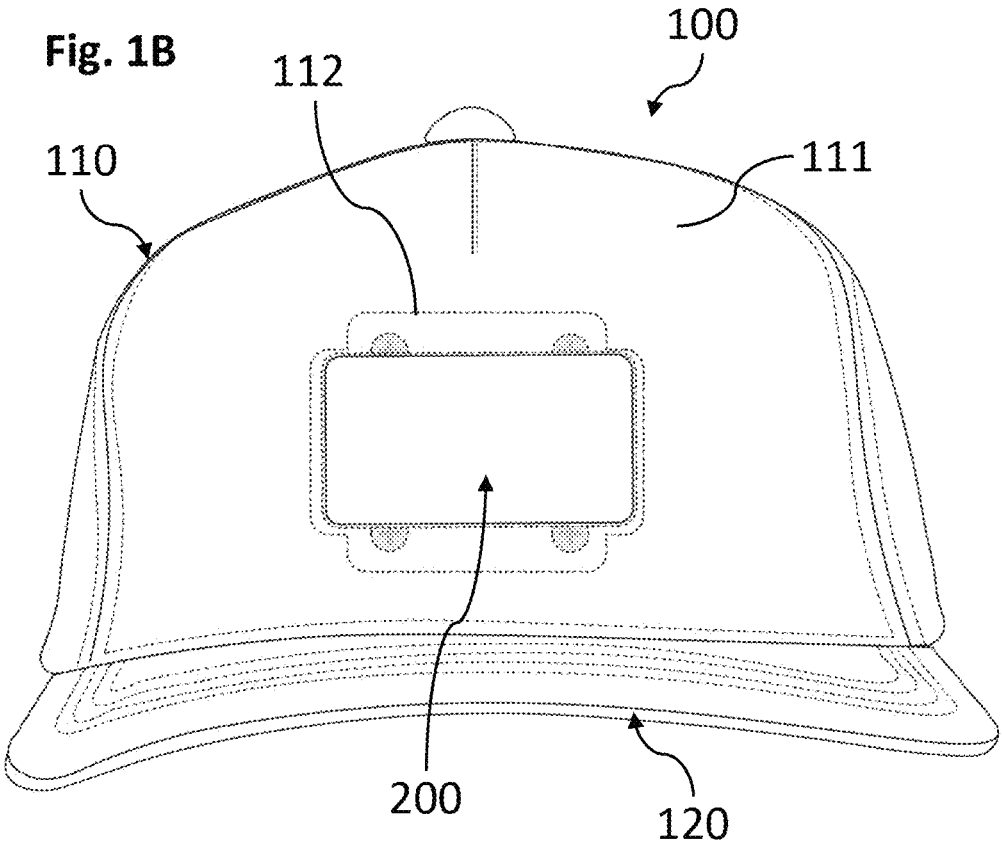

FIG. 1A exemplarily shows a schematic side view of a wearable cap 100 (fashion article) with a magnetically attachable patch 200 according to exemplary embodiments. FIG. 1B exemplarily shows a schematic front view of the wearable cap 100 with the magnetically attachable patch 200 according to FIG. 1A.

Exemplarily, the wearable cap 100 includes a cap body 110 with a front shield 120 exemplarily attached at the lower front-side of the cap body 110. Exemplarily, the cap body 110 of the wearable cap 100 includes a front panel 111. The face (outer face portion) of the front panel 111 may include one or more layers of fabric (e.g. cotton). The front panel 111 may also include an inner support layer which may include one or more buckram layers.

Exemplarily, a magnetically attachable patch 200 (patch element) is detachably attached at the front panel 111 of the wearable cap 100, exemplarily from the outer side. As can be seen exemplarily in FIG. 1B, the magnetically attachable patch 200 exemplarily has a rectangular shape with rounded corners in the exemplary embodiments according to FIGS. 1A and 1B.

In some exemplary embodiments, the magnetically attachable patch 200 includes one or more magnetic portions for the magnetic attachment to the front panel 111 of the cap body 110 of the wearable cap 100. Preferred exemplary embodiments of such magnetic portions and preferred arrangements thereof will be described further below in connection with further exemplary embodiments.

Preferably, in some exemplary embodiments, the magnetically attachable patch 200 may be configured to be detached from the front panel 111 of the cap body 110 of the wearable cap 100. For example, the user may wish to replace the magnetically attachable patch 200 by another patch (e.g. with another shape, another coloring, another front image and/or front text, etc.) or the user may wish to temporarily wear the cap 100 without front-side patch.

Figure 1C:
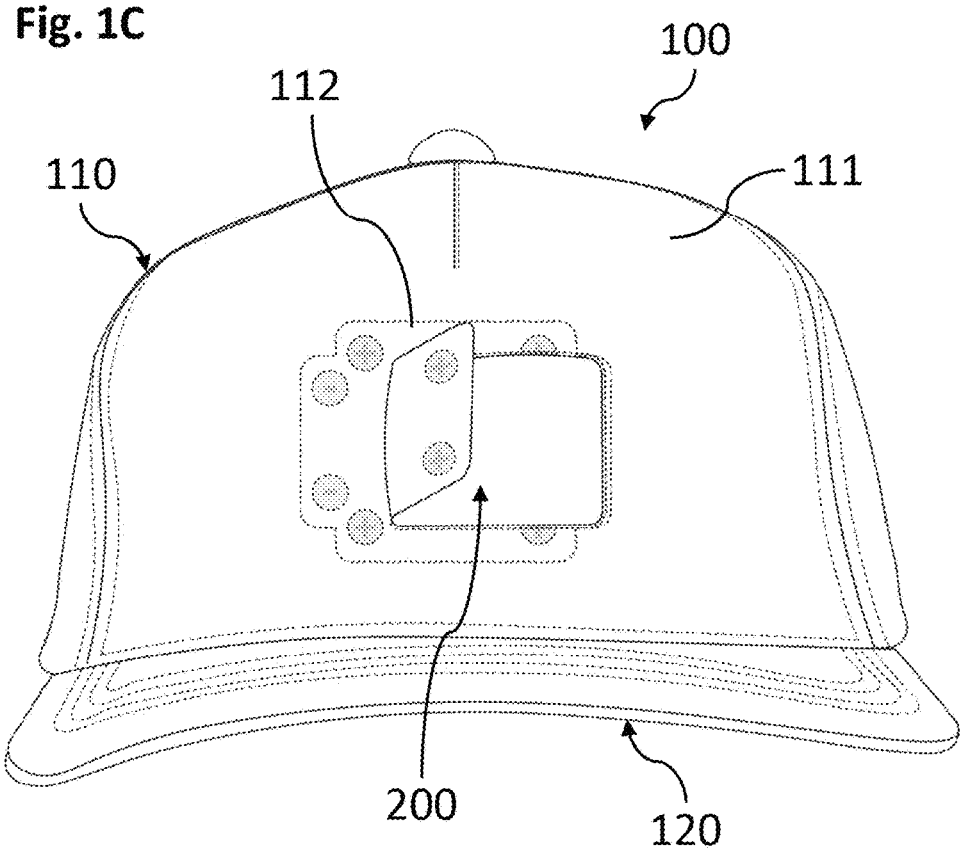

FIG. 1C exemplarily shows a schematic front view of the wearable cap 100 with the exemplarily partially removed magnetically attachable patch 200 according to FIG. 1A. That is, the user can remove the magnetically attachable patch 200 e.g. by manually stripping away or pulling off the magnetically attachable patch 200 from the front panel 111 of the cap body 110 of the wearable cap 100, e.g. as shown in FIG. 1C.

Figure 2:
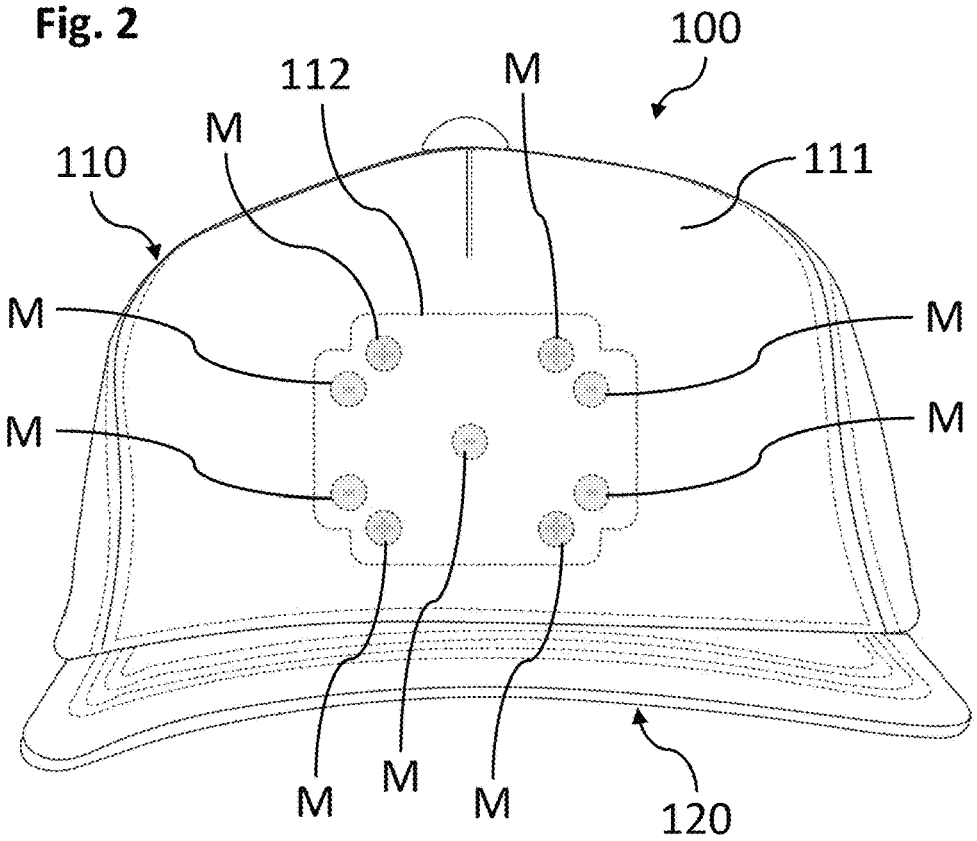

FIG. 2 exemplarily shows a schematic front view of a wearable cap 100 according to FIGS. 1A to 1C exemplarily without the magnetically attachable patch 200.

Exemplarily, the front panel 111 of the cap body 110 of the wearable cap 100 includes a magnetic attachment portion 112 for the magnetic attachment of the magnetically attachable patch 200 (and/or other magnetically attachable patches).

The magnetic attachment portion 112, which is exemplarily arranged at the front panel 111 of the cap body 110 of the wearable cap 100, is further exemplarily embedded into the front panel 111, preferably so as to be invisible to the outside.

For example, in some exemplary embodiments, the magnetic attachment portion 112 may be covered by at least one outside face layer of the front panel 111 of the cap body 110, e.g. covered at least by a fabric or textile layer. This is indicated exemplarily in FIGS. 1A to 1C and 2 by the magnetic attachment portion 112 being shown by dashed lines. For example, the magnetic attachment portion 112 is exemplarily covered to the outside by at least one textile layer, e.g. one or more layers of fabric such as e.g. cotton.

That is, viewed from the outside onto the front panel 111, the user exemplarily does not see the magnetic attachment portion 112 exemplarily arranged inside of the front panel 111 of the cap body 110, but the user may only see an outside face, e.g. made of or including fabric.

In some exemplary embodiments, the front face of the front panel 111 of the cap body 110 may exemplarily include images, logos, and/or text. Such images, logos and/or text may be printed on the front face (e.g. by silicone), be attached or otherwise applied to the front face (e.g. by means of stickers and/or by gluing) and/or be embroidered onto the front face of the front panel 111 of the cap body 110.

Exemplarily, the magnetic attachment portion 112 includes a plurality of magnets M arranged in a pre-determined pattern for attachment of the magnetically attachable patch 200 and/or other magnetically attachable patches. The magnet arrangement of the magnet pattern of magnets M is exemplarily configured for adjustment of the position of the magnetically attachable patch 200 when attached (please also see FIGS. 6A to 6C for exemplary magnet patterns).

For example, in the magnetic attachment portion 112 the magnets M may be arranged so that some magnets M have a first polarity (e.g. indicated by +) facing the magnetically attachable patch 200 and some other magnets M have a second polarity (e.g. indicated by −) facing the magnetically attachable patch 200. The first polarity may indicate a North pole of the respective magnet and the second polarity may indicate a South pole of the respective magnet (or vice versa).

Further exemplarily, in the magnetic attachment portion 112 some the magnets M may be arranged according to a first pattern configured to attach a first-type magnetically attachable patch and other magnets M may be arranged according to a second pattern configured to attach a second-type magnetically attachable patch. For example, such first-type patches and second-type patches may differ in size, shape, color, front-side appearance (e.g. with different images, logos and/or text).

Figure 3A:
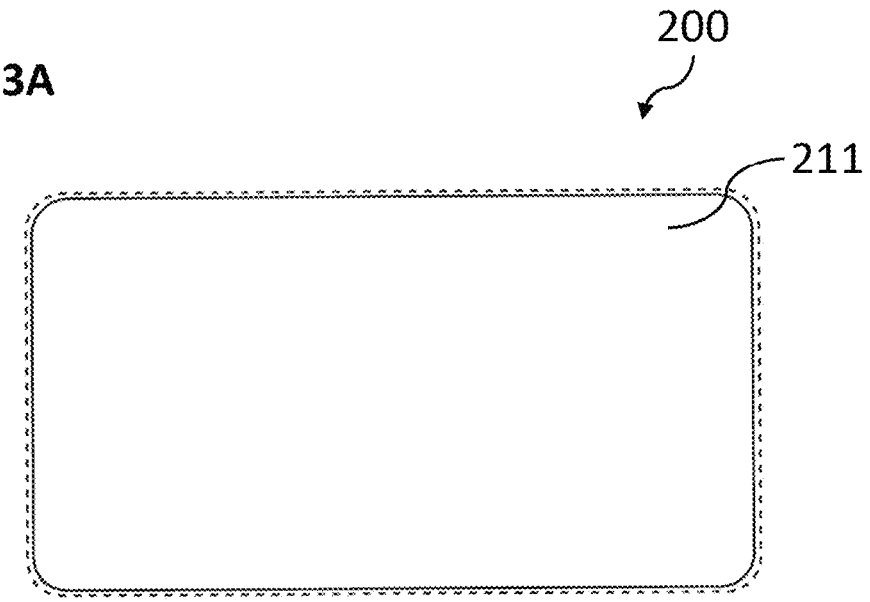

FIG. 3A exemplarily shows a schematic front view of the magnetically attachable patch 200 (patch element) according to exemplary embodiments.

As previously described, the magnetically attachable patch 200 exemplarily has a rectangular shape with rounded corners as in the exemplary embodiments according to FIGS. 1A and 1B.

In some exemplary embodiments, the front face of the magnetically attachable patch 200 (i.e. at the side facing away from the cap 100) may exemplarily include images, logos, and/or text. Such images, logos and/or text may be printed on the front face of the magnetically attachable patch 200 (e.g. by silicone), be attached or otherwise applied to the front face of the magnetically attachable patch 200 (e.g. by means of stickers and/or by gluing) and/or be embroidered onto the front face of the magnetically attachable patch 200.

In further exemplary embodiments, also the back face of the magnetically attachable patch 200 may exemplarily include images, logos, and/or text.

In some exemplary embodiments, the magnetically attachable patch 200, and in particularly the outside face layer(s), may include fabric such as e.g. natural textile layers (e.g. textile layers made of cotton or including cotton), and/or synthetic fabric layers. The magnetically attachable patch 200 may additionally or alternatively include other flexible layers such as e.g. leather or synthetic leather layers.

Exemplarily, in FIG. 3A, the magnetically attachable patch 200 includes a front side fabric layer 211, e.g. including cotton.

Figure 3B:
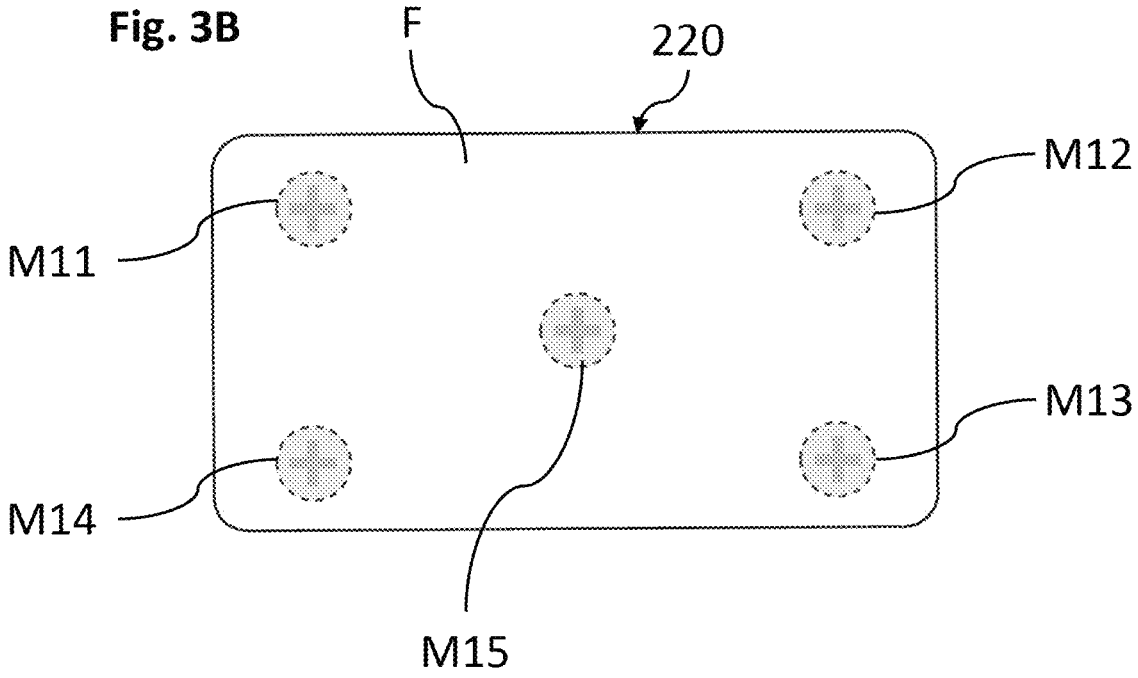

FIG. 3B exemplarily shows a schematic view of a magnet patch layer 220 of a magnetically attachable patch according to FIG. 3A. Preferably, such magnet patch layer 220 may be embedded in the magnetically attachable patch 200.

Exemplarily, the magnet patch layer 220 includes plural magnets M11 to M15 arranged according to a pre-determined pattern (first-type pattern). Exemplarily, the four magnets M11 to M14 are arranged according to the corners of a rectangle. Specifically, the four magnets M11 to M14 are exemplarily arranged in proximity to the corners of the exemplary rectangular shape of the magnetically attachable patch 200.

Exemplarily, another magnet M15 is exemplarily arranged in a centered position between the four magnets M11 to M14, preferably in a center position of the shape of the magnetically attachable patch 200.

Further exemplarily, the magnets M11 to M15 are exemplarily arranged so that the four magnets M11 to M14 have a first polarity (e.g. indicated by +) facing the back side to be attached to the magnetic attachment portion 112 of the wearable cap 100 (i.e. facing the magnetic attachment portion 112 of the wearable cap 100 when attached) and, exemplarily, the magnet M15 has also the first polarity (e.g. indicated by +) facing the back side to be attached to the magnetic attachment portion 112 of the wearable cap 100 (i.e. facing the magnetic attachment portion 112 of the wearable cap 100 when attached).

Exemplarily, the magnet patch layer 220 includes the plural magnets M11 to M15 arranged according to a pre-determined pattern (first-type pattern) that corresponds to at least a part of the pre-determined pattern of magnets M of the magnetic attachment portion 112. Specifically, exemplarily each of the plural magnets M11 to M15 of the magnet patch layer 220 has a corresponding magnet of the opposite polarity in the pre-determined pattern of magnets M of the magnetic attachment portion 112, see e.g. FIGS. 6A and 6B.

When attaching the magnetically attachable patch 200 to the front panel 111 of the wearable cap 100, each of the plural magnets M11 to M15 of the magnet patch layer 220 may magnetically engage with its corresponding magnet of the opposite polarity in the pre-determined pattern of magnets M of the magnetic attachment portion 112.

This has the beneficial effect that the magnetically attachable patch 200 can be accurately be attached to the front panel III of the wearable cap 100 in the correct pre-determined position and orientation, even without any requirements for visual inspections and without the need of adjustments. That is, the user can easily and quickly attach the magnetically attachable patch 200 to the front panel 111 of the wearable cap 100 in the correct position and orientation, even without looking or even when wearing the cap 100.

Exemplarily, the magnet patch layer 220 of the magnetically attachable patch 200 includes one or more flexible foils F, e.g. including or being made of plastic. The foil F may preferably hold the magnets M11 to M15 in position according to the pre-determined pattern.

In preferred exemplary embodiments, the magnet patch layer 220 of the magnetically attachable patch 200 may include at least two flexible foils F holding the magnets M11 to M15 in between the at least two foils F.

In manufacture, the magnet patch layer 220 can be easily and efficiently be produced, e.g. by heat-pressing the at least two foils together with the magnets M11 to M15 being arranged according to the pre-determined pattern in between the at least two foils F.

In some exemplary embodiments, the foil(s) F may be made of or include flexible plastic, such as e.g. PVC (polyvinyl chloride) or more preferably the more flexible TPU (thermoplastic polyurethane).

Figure 3C:
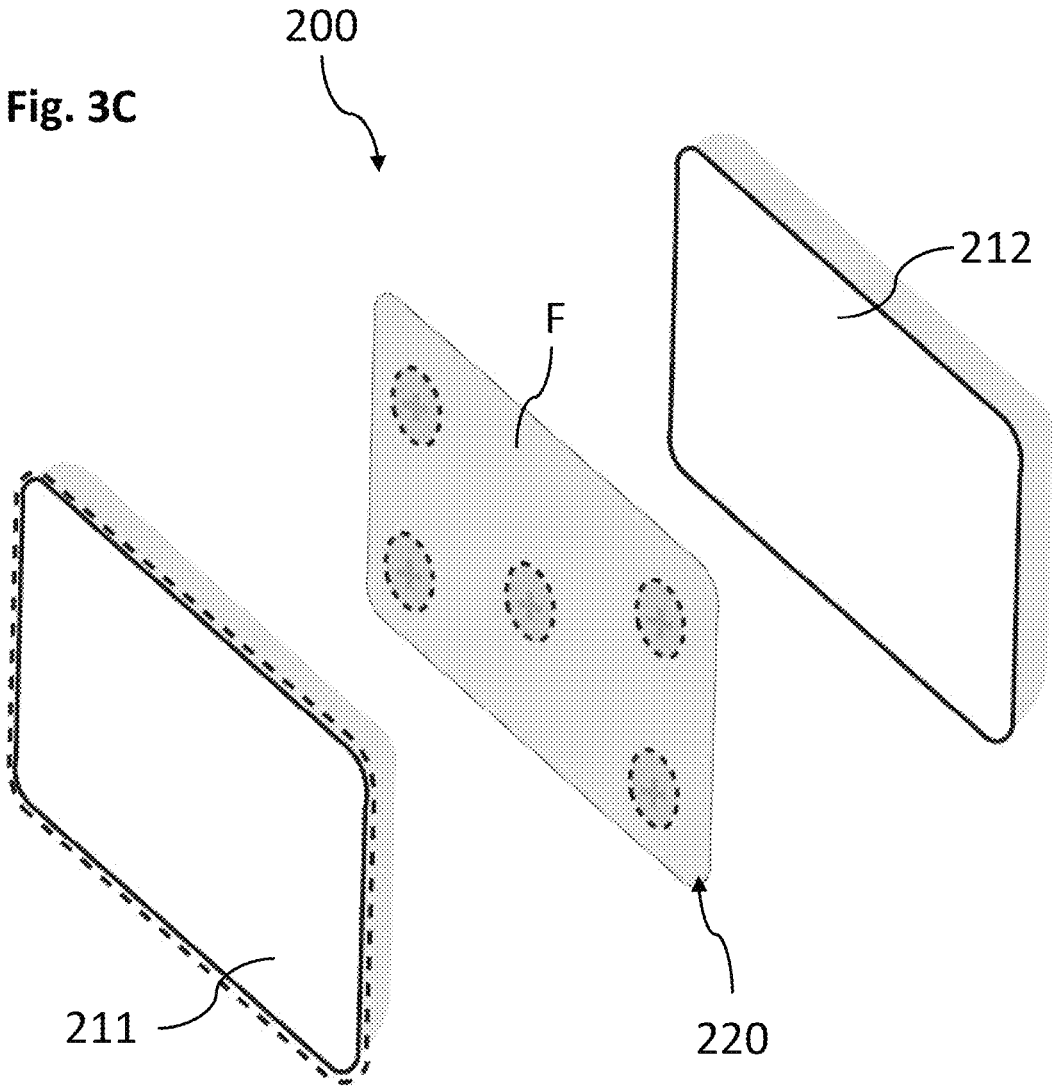

FIG. 3C exemplarily shows a schematic explosive view of a magnetically attachable patch 200 according to FIG. 3A.

Exemplarily, the magnetically attachable patch 200 includes the front side fabric layer 211 and a back side fabric layer 212 as well as the magnet patch layer 220 arranged between the front side fabric layer 211 and the back side fabric layer 212.

Exemplarily, the front side fabric layer 211, the back side fabric layer 212 and the magnet patch layer 220 have the similar rectangular shape so that they can be fitted together and positioned with respect to each other easily and accurately in manufacture. Also, this allows to efficiently glue and/or sew together the front side fabric layer 211, the back side fabric layer 212 and the magnet patch layer 220, e.g. by stitching together the edges of the front side fabric layer 211, the back side fabric layer 212 and the magnet patch layer 220.

Figure 4A:
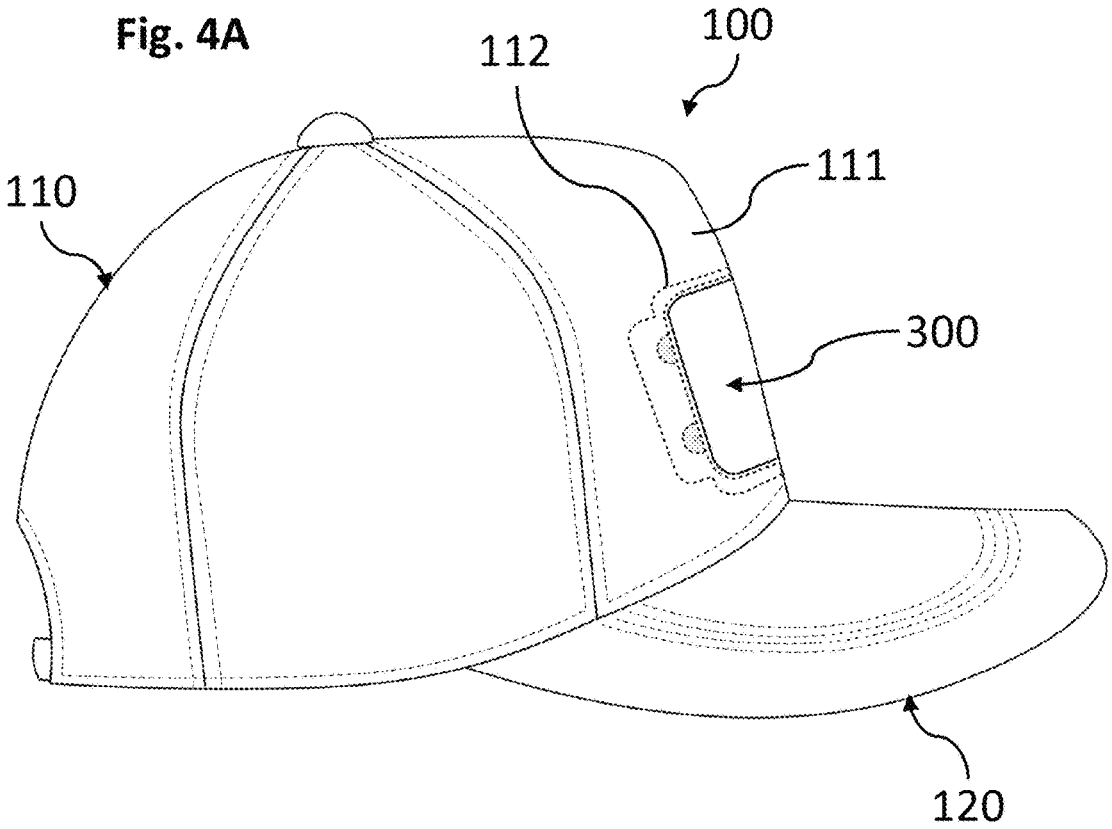
Figure 4B:
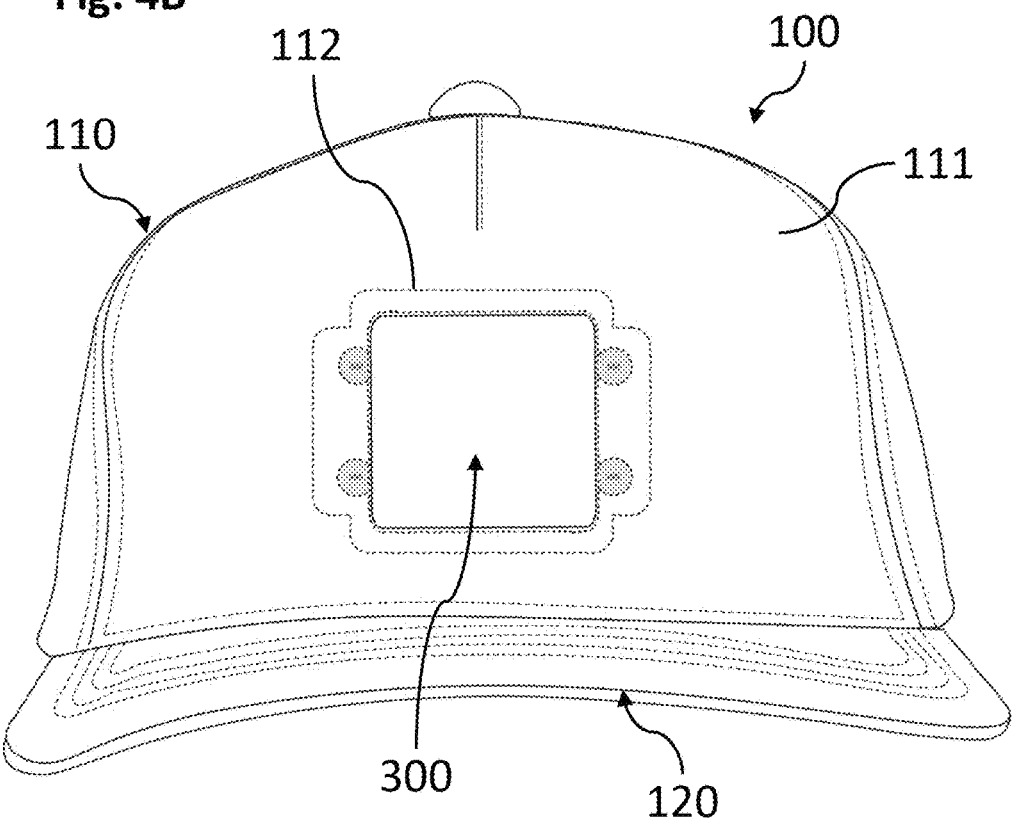

FIG. 4A exemplarily shows a schematic side view of a wearable cap 100 (fashion article) with another magnetically attachable patch 300 according to other exemplary embodiments. FIG. 4B exemplarily shows a schematic front view of the wearable cap 100 with the magnetically attachable patch 300 according to FIG. 4A.

Exemplarily, similar to the exemplary embodiments above, the wearable cap 100 includes a cap body 110 with a front shield 120 exemplarily attached at the lower front-side of the cap body 110. Exemplarily, the cap body 110 of the wearable cap 100 includes a front panel 111.

Exemplarily, another magnetically attachable patch 300 (patch element) is detachably attached at the front panel 111 of the wearable cap 100. As can be seen exemplarily in FIG. 4B, the magnetically attachable patch 300 exemplarily has a square shape, further exemplarily with rounded corners, in the exemplary embodiments according to FIGS. 4A and 4B.

In some exemplary embodiments, the magnetically attachable patch 300 includes one or more magnetic portions for the magnetic attachment to the front panel 111 of the cap body 110 of the wearable cap 100. Preferred exemplary embodiments of such magnetic portions and preferred arrangements thereof will be described further below in connection with further exemplary embodiments.

Preferably, similar to above embodiments, in some exemplary embodiments, the magnetically attachable patch 300 may be configured to be detached from the front panel 111 of the cap body 110 of the wearable cap 100.

Figure 4C:
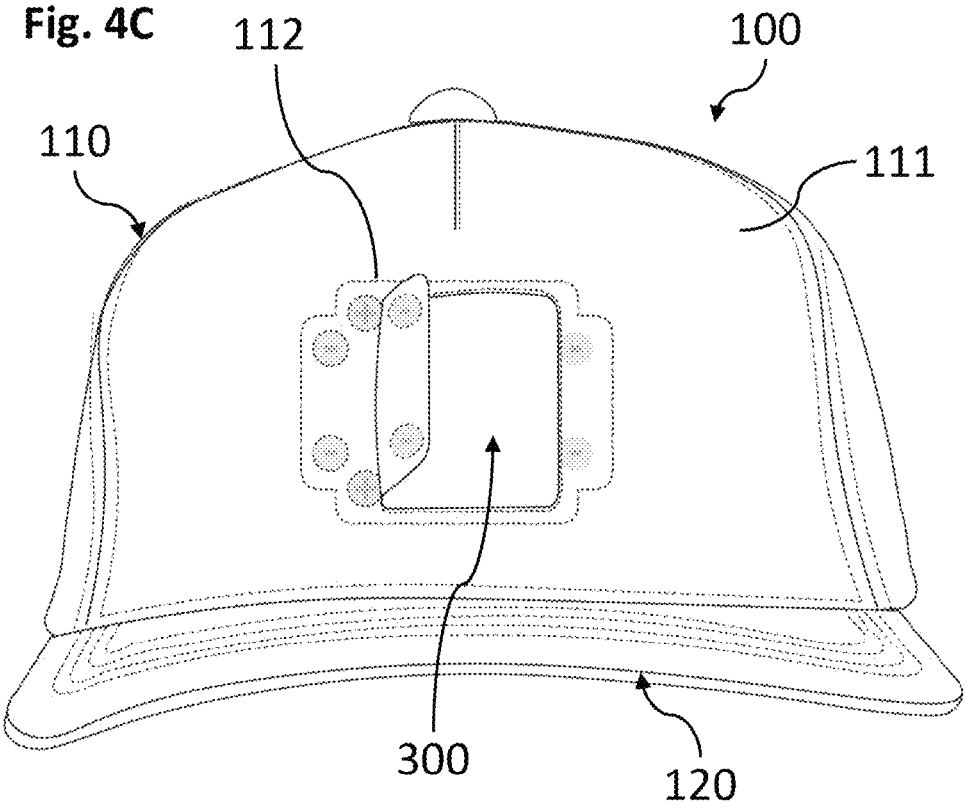

FIG. 4C exemplarily shows a schematic front view of the wearable cap 100 with the exemplarily partially removed magnetically attachable patch 300 according to FIG. 4A.

That is, similar to above embodiments, the user can remove the magnetically attachable patch 300 e.g. by manually stripping away or pulling off the magnetically attachable patch 300 from the front panel 111 of the cap body 110 of the wearable cap 100, e.g. as shown in FIG. 4C.

Exemplarily, the magnetically attachable patch 300 is compatible with the wearable cap 100 as described above in connection with FIG. 2, and above explanations of the exemplary wearable cap 100 as described above in connection with FIG. 2 do apply.

Figure 5A:
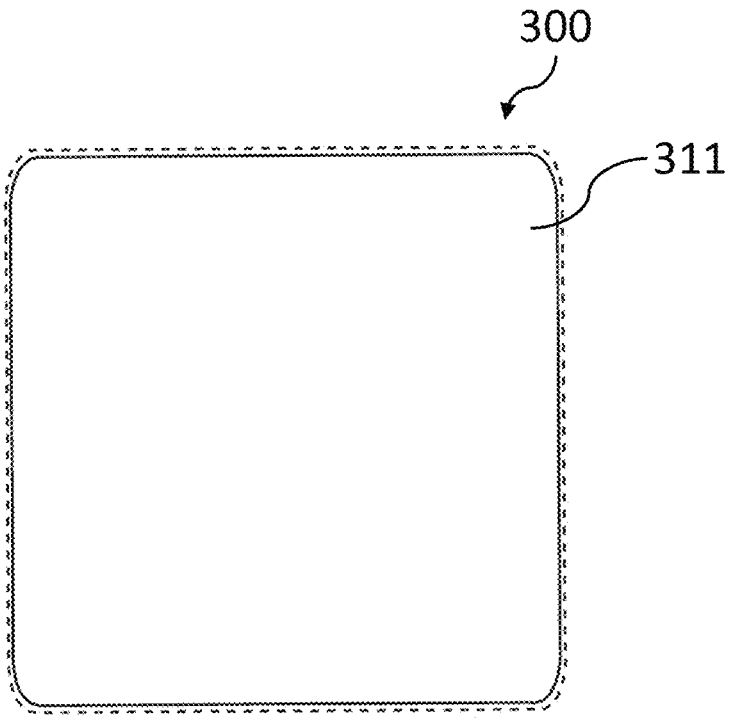

FIG. 5A exemplarily shows a schematic front view of the magnetically attachable patch 300 (patch element) according to other exemplary embodiments.

As previously described, the magnetically attachable patch 300 exemplarily has a square shape, further exemplarily with rounded corners, as in the exemplary embodiments according to FIGS. 4A and 4B.

In some exemplary embodiments, the front face of the magnetically attachable patch 300 (i.e. at the side facing away from the cap 100) may exemplarily include images, logos, and/or text. Such images, logos and/or text may be printed on the front face of the magnetically attachable patch 200 (e.g. by silicone), be attached or otherwise applied to the front face of the magnetically attachable patch 300 (e.g. by means of stickers and/or by gluing) and/or be embroidered onto the front face of the magnetically attachable patch 300.

In further exemplary embodiments, also the back face of the magnetically attachable patch 300 may exemplarily include images, logos, and/or text.

In some exemplary embodiments, the magnetically attachable patch 300, and in particularly the outside face layer(s), may include fabric such as e.g. natural textile layers (e.g. textile layers made of cotton or including cotton), and/or synthetic fabric layers. The magnetically attachable patch 300 may additionally or alternatively include other flexible layers such as e.g. leather or synthetic leather layers.

Exemplarily, in FIG. 5A, the magnetically attachable patch 300 includes a front side fabric layer 311, e.g. including cotton.

Figure 5B:
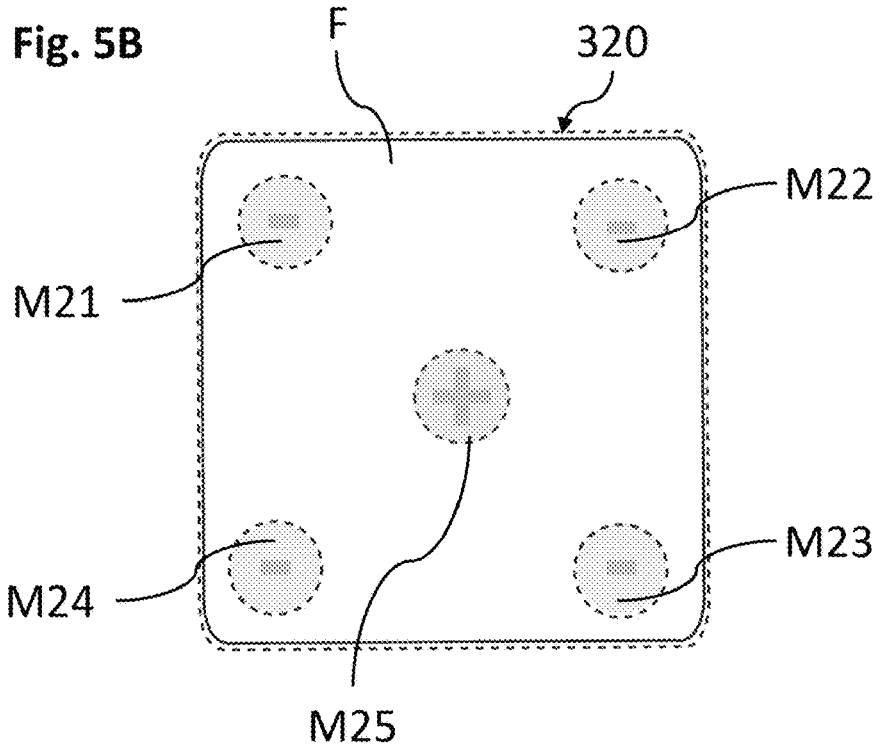

FIG. 5B exemplarily shows a schematic view of another magnet patch layer 320 of the magnetically attachable patch 300 according to FIG. 5A. Preferably, such magnet patch layer 320 may be embedded in the magnetically attachable patch 300.

Exemplarily, the magnet patch layer 320 includes plural magnets M21 to M25 arranged according to a pre-determined pattern (second-type pattern). Exemplarily, the four magnets M21 to M24 are arranged according to the corners of a square. Specifically, the four magnets M21 to M24 are exemplarily arranged in proximity to the corners of the exemplary square shape of the magnetically attachable patch 300.

Exemplarily, another magnet M25 is exemplarily arranged in a centered position between the four magnets M21 to M24, preferably in a center position of the shape of the magnetically attachable patch 300.

Further exemplarily, the magnets M21 to M25 are exemplarily arranged so that the four magnets M21 to M24 have a second polarity (e.g. indicated by –) facing the back side to be attached to the magnetic attachment portion 112 of the wearable cap 100 (i.e. facing the magnetic attachment portion 112 of the wearable cap 100 when attached) and the magnet M25 has a first polarity (e.g. indicated by +) facing the back side to be attached to the magnetic attachment portion 112 of the wearable cap 100 (i.e. facing the magnetic attachment portion 112 of the wearable cap 100 when attached).

Exemplarily, the magnet patch layer 320 includes the plural magnets M21 to M25 arranged according to a pre-determined pattern (second-type pattern) that corresponds to at least a part of the pre-determined pattern of magnets M of the magnetic attachment portion 112. Specifically, exemplarily each of the plural magnets M21 to M25 of the magnet patch layer 320 has a corresponding magnet of the opposite polarity in the pre-determined pattern of magnets M of the magnetic attachment portion 112, see e.g. FIGS. 6A and 6C.

When attaching the magnetically attachable patch 300 to the front panel 111 of the wearable cap 100, each of the plural magnets M21 to M25 of the magnet patch layer 320 may magnetically engage with its corresponding magnet of the opposite polarity in the pre-determined pattern of magnets M of the magnetic attachment portion 112.

This has the beneficial effect that the magnetically attachable patch 300 can be accurately be attached to the front panel 111 of the wearable cap 100 in the correct pre-determined position and orientation, even without any requirements for visual inspections and without the need of adjustments. That is, the user can easily and quickly attach the magnetically attachable patch 300 to the front panel 111 of the wearable cap 100 in the correct position and orientation, even without looking or even when wearing the cap 100.

Exemplarily, similar to the exemplary magnet patch layer 220 above, the magnet patch layer 320 of the magnetically attachable patch 300 includes one or more flexible foils F, e.g. including or being made of plastic. The foil F may preferably hold the magnets M21 to M25 in position according to the pre-determined pattern.

That is, in manufacture, the magnet patch layer 320 can be easily and efficiently be produced, e.g. by heat-pressing the at least two foils together with the magnets M21 to M25 being arranged according to the pre-determined pattern in between the at least two foils F.

Embedding or providing the magnet patch layer of the patch element between two foils, in particular synthetic foils, allows the additional benefit that the magnets can be protected from water, e.g. to provide improved weather protection and/or protection from water when cleaning the patch or the textile or fashion article with attached patch.

Figure 5C:
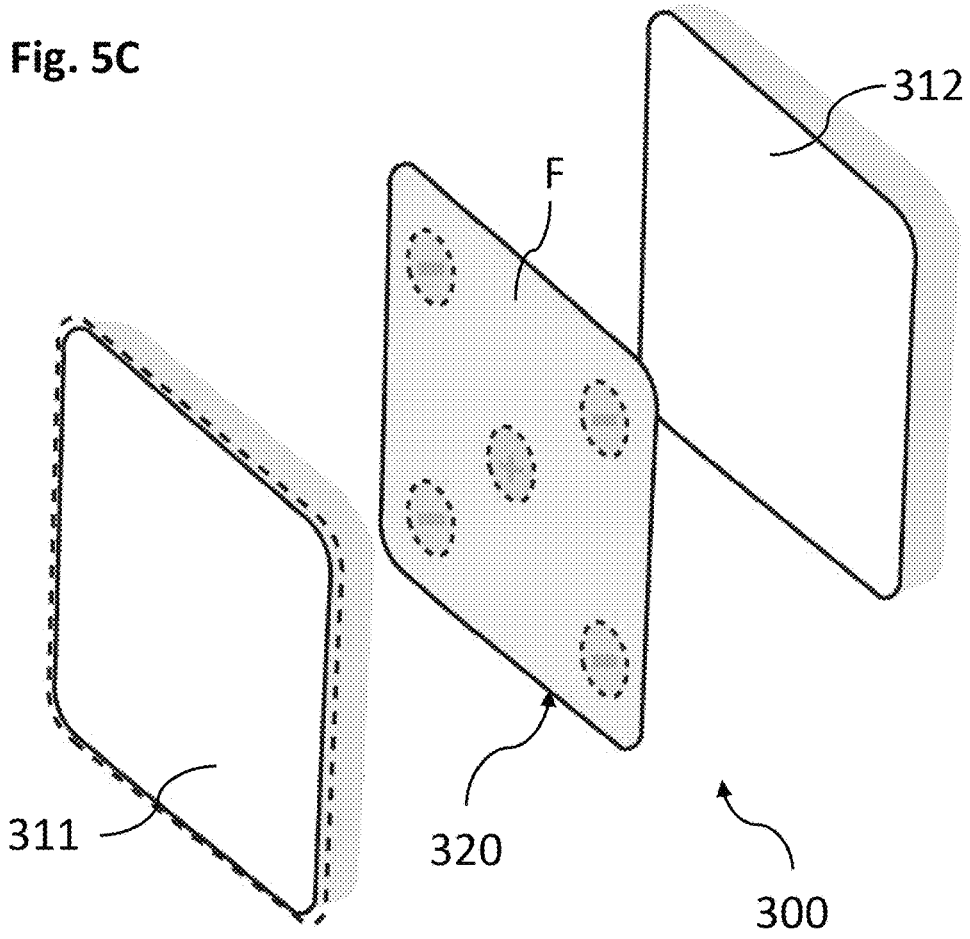

FIG. 5C exemplarily shows a schematic explosive view of the magnetically attachable patch 300 according to FIG. 5A.

Exemplarily, the magnetically attachable patch 300 includes the front side fabric layer 311 and a back side fabric layer 312 as well as the magnet patch layer 320 arranged between the front side fabric layer 311 and the back side fabric layer 312.

Exemplarily, the front side fabric layer 311, the back side fabric layer 312 and the magnet patch layer 320 have the similar square shape so that they can be fitted together and positioned with respect to each other easily and accurately in manufacture. Also, this allows to efficiently glue and/or sew together the front side fabric layer 311, the back side fabric layer 312 and the magnet patch layer 320, e.g. by stitching together the edges of the front side fabric layer 311, the back side fabric layer 312 and the magnet patch layer 320.

In the above, exemplarily, embodiments have been discussed with magnetically attachable patches of the rectangular shape or the square shape. Of course, other embodiments can be provided with magnetically attachable patches of other shapes and sizes. For example, other magnetically attachable patches may be provided in the shapes of triangles, trapezoids, pentagons, hexagons, heptagons, octagons or other angular shapes. Furthermore, other magnetically attachable patches may be provided in the rounded shapes such as the shapes of a circle, elliptical or oval shapes. Also, irregular patch shapes may be provided in other exemplary embodiments, e.g. freeform shape patches.

In the above exemplary embodiments, the magnetically attachable patches exemplarily include, preferably embedded, magnet pattern patch layers having plural magnets of a pre-determined magnet pattern arrangement, wherein the corresponding magnetic attachment portion, which is preferably embedded in the cap body of the wearable cap in exemplary embodiments (or other faces or layers of another fashion article), includes a corresponding pattern of magnets, preferably such that exemplarily each of the plural magnets of the magnet patch layer of the patch has a corresponding magnet of the opposite polarity in the pre-determined pattern of magnets of the magnetic attachment portion.

This has the beneficial effect that the magnetically attachable patch can be accurately be attached to the corresponding magnetic attachment portion of the textile or fashion article in the correct pre-determined position and orientation, even without any requirements for visual inspections and without the need of adjustments. That is, the user can easily and quickly attach the magnetically attachable patch to the textile or fashion article in the correct pre-determined position and orientation, even without looking.

In even more preferable exemplary embodiments, the magnetic attachment portion includes a magnet pattern arrangement including two or more distinct pattern of magnets, each of the patterns corresponding to a respective magnet pattern of a respective magnetically attachable patch of two or more types of patches. Accordingly, different patches of two or more types can be attached to the same magnetic attachment portion, each respectively in the correct pre-determined position and/or orientation. Such exemplary patterns of magnets are exemplarily described below.

Figure 6A:
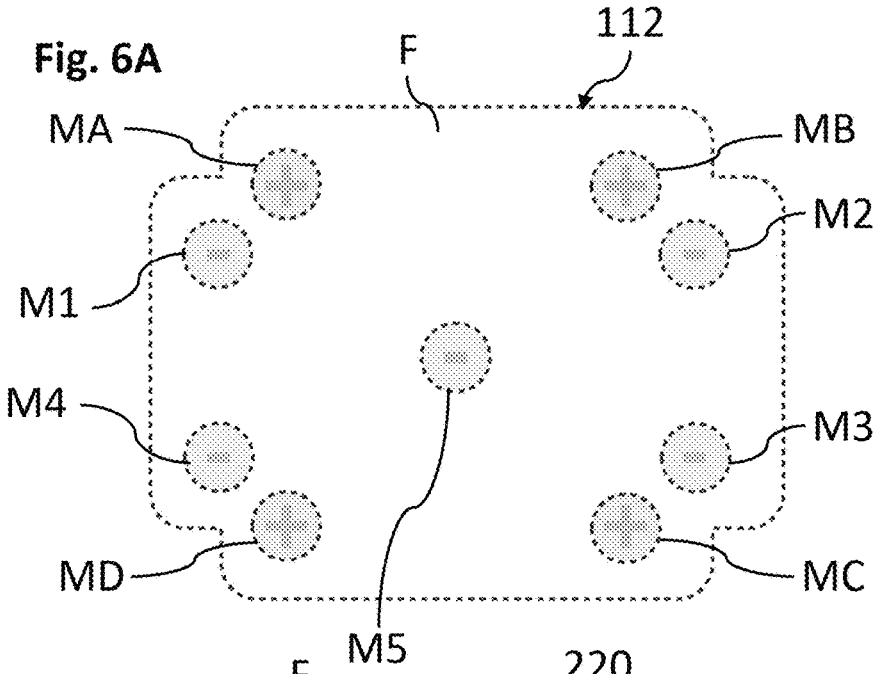

FIG. 6A exemplarily shows a schematic view of a magnet patch layer of the magnetic attachment portion 112 of a textile or fashion article such as e.g. the wearable cap 100 according to exemplary embodiments (see e.g. FIG. 2).

Exemplarily, the magnet patch layer of the magnetic attachment portion 112 includes plural magnets M1 to M2 arranged according to a pre-determined pattern (first-type pattern) and further includes plural magnets MA to MD arranged according to another pre-determined pattern (second-type pattern).

Exemplarily, the four magnets M1 to M4 are arranged according to the corners of a rectangle. Specifically, the four magnets M1 to M1 are exemplarily arranged according to the similar pattern as the magnets M11 to M14 of the magnet patch layer 220 of the magnetically attachable patch 200 (see e.g. FIG. 6B), however with opposite (i.e. attractive) polarity compared to the magnets M11 to M14 of the magnet patch layer 220 of the magnetically attachable patch 200. Accordingly, the magnets M1 to M4 are arranged so as to allow for attachment of the magnet patch layer 220 of the magnetically attachable patch 200.

Further exemplarily, the four magnets MA to MD are arranged according to the corners of a square. Specifically, the four magnets MA to MD are exemplarily arranged according to the similar pattern as the magnets M21 to M24 of the magnet patch layer 320 of the magnetically attachable patch 300 (see e.g. FIG. 6C), however with opposite (i.e. attractive) polarity compared to the magnets M21 to M24 of the magnet patch layer 320 of the magnetically attachable patch 300. Accordingly, the magnets MA to MD are arranged so as to allow for attachment of the magnet patch layer 320 of the magnetically attachable patch 300.

Exemplarily, the magnets M1 to M2 arranged according to the first-type pattern have the opposite polarity compared to the magnets MA to MD arranged according to the second-type pattern.

This has the beneficial effect that incorrect placement/attachment of the respective magnetically attachable patches can be conveniently avoided despite the larger number of magnets, e.g. in that the magnets M1 to M2 arranged according to the first-type pattern act to correctly attract the magnets M11 to M14 of the magnet patch layer 220 of the magnetically attachable patch 200 in the correct position and orientation, while repelling the magnets M21 to M24 of the magnet patch layer 320 of the magnetically attachable patch 300 to avoid its misplaced attachment, and/or in that the magnets MA to MD arranged according to the second-type pattern act to correctly attract the magnets M21 to M24 of the magnet patch layer 320 of the magnetically attachable patch 300 in the correct position and orientation, while repelling the magnets M11 to M14 of the magnet patch layer 220 of the magnetically attachable patch 200 to avoid its misplaced attachment.

Furthermore, another magnet M5 is exemplarily arranged in a centered position between the four magnets M1 to M4 and further arranged in a centered position between the four magnets MA to MD. This has the beneficial effect that the same centered attachment position of the respective magnetically attachable patches can be conveniently achieved, in that each of the first-type and second-type magnet patterns shares at least one common centering magnet position (magnet M5 corresponding to each of magnets M15 and M25 in the respective patterns).

It is to be noted that the magnetic attachment portion 112 may also exemplarily include one or more foils F. Exemplarily, the magnet patch layer of the magnetic attachment portion 112 may then include one or more flexible foils F, e.g. including or being made of plastic. The foil F may preferably hold the magnets M1 to M5 and MA to Md in position according to the pre-determined patterns.

In preferred exemplary embodiments, the magnet patch layer of the magnetic attachment portion 112 may include at least two flexible foils F holding the magnets M1 to M5 and MA to MD in between the at least two foils F.

In manufacture, the magnet patch layer of the magnetic attachment portion 112 can be easily and efficiently be produced, e.g. by heat-pressing the at least two foils together with the magnets M1 to M5 and MA to MD being arranged according to the pre-determined patterns in between the at least two foils F.

Embedding or providing the magnet patch layer of the magnetic attachment portion 112 between two foils, in particular synthetic foils, allows the additional benefit that the magnets can be protected from water, e.g. to provide improved weather protection and/or protection from water when cleaning the textile or fashion article or the outer face of the textile or fashion article.

In some exemplary embodiments, the foil(s) F may be made of or include flexible plastic, such as e.g. PVC (polyvinyl chloride) or the more flexible TPU (thermoplastic polyurethane). In this case, the use of the less flexible PVC (polyvinyl chloride) may be preferable to provide a less flexible structure supporting the textile or fashion article's shape and more stable attachment of the higher number of magnets.

Figure 6B:
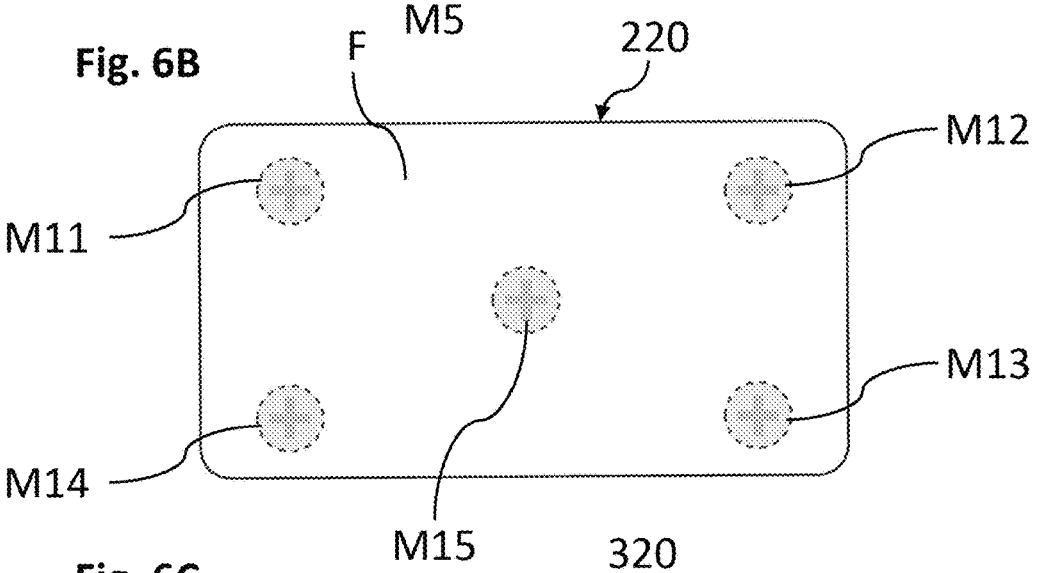

FIG. 6B exemplarily shows a schematic view of a first-type magnet patch layer 220 of a magnetically attachable patch 220 exemplarily adapted to the magnet patch layer 112 of FIG. 6A. Herein, exemplarily the first-type magnet patch layer 220 includes the first-type magnet pattern including the exemplary rectangular arrangement of magnets M11 to M14 with positive polarity opposite to the corresponding negative polarity magnets M1 to M4 of the magnet pattern arrangement of the magnetic attachment portion 112 according to FIG. 6A. Also, the first-type magnet patch layer 220 includes the centered magnet M15 with positive polarity opposite to the corresponding centered negative polarity magnet M5 of the magnet pattern arrangement of the magnetic attachment portion 112 according to FIG. 6A.

Figure 6C:
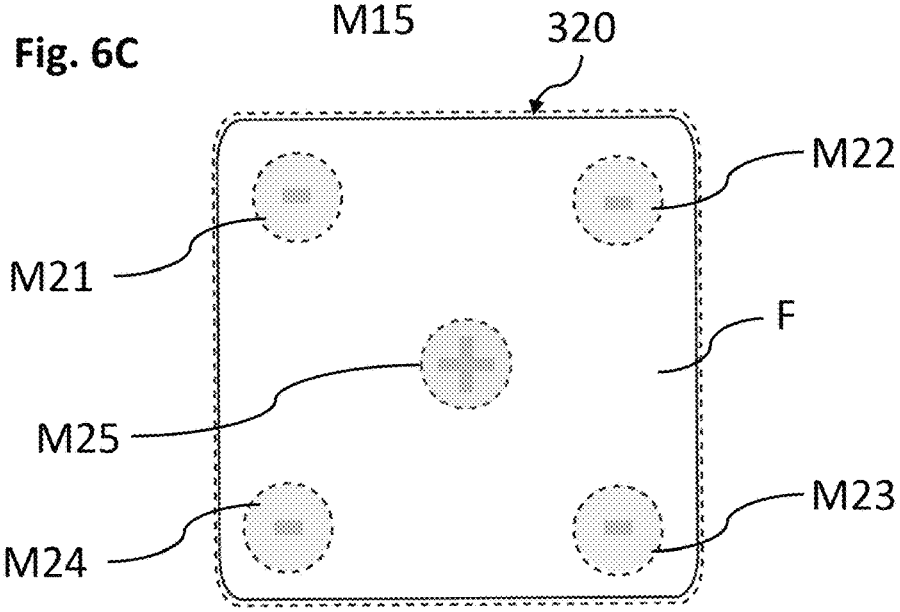

FIG. 6C exemplarily shows a schematic view of a second-type magnet patch layer 320 of a magnetically attachable patch 300 exemplarily adapted to the magnet patch layer 112 of FIG. 6A. Herein, exemplarily the second-type magnet patch layer 320 includes the second-type magnet pattern including the exemplary square arrangement of magnets M21 to M24 with negative polarity opposite to the corresponding positive polarity magnets MA to MD of the magnet pattern arrangement of the magnetic attachment portion 112 according to FIG. 6A. Also, the second-type magnet patch layer 320 includes the centered magnet M25 with positive polarity opposite to the corresponding centered negative polarity magnet M5 of the magnet pattern arrangement of the magnetic attachment portion 112 according to FIG. 6A.

Figure 7A:
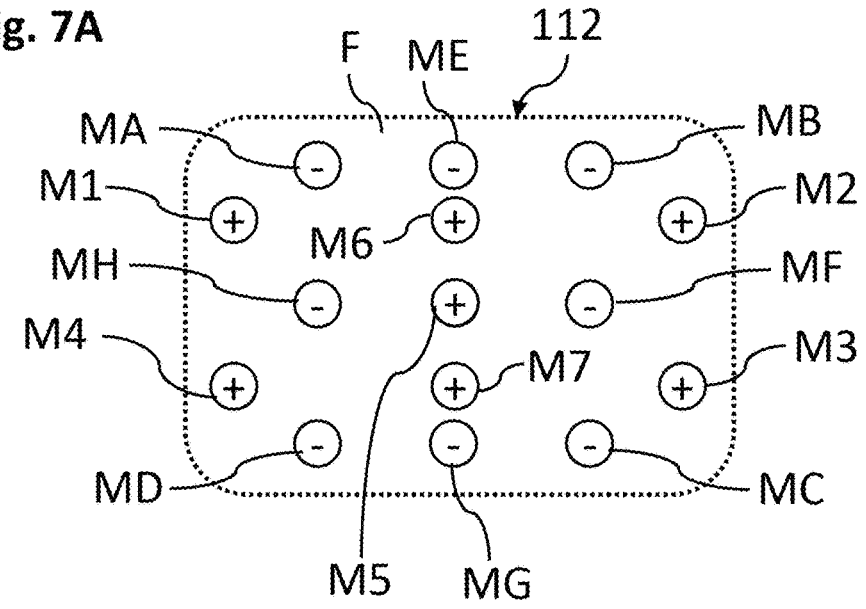
Figure 7B:
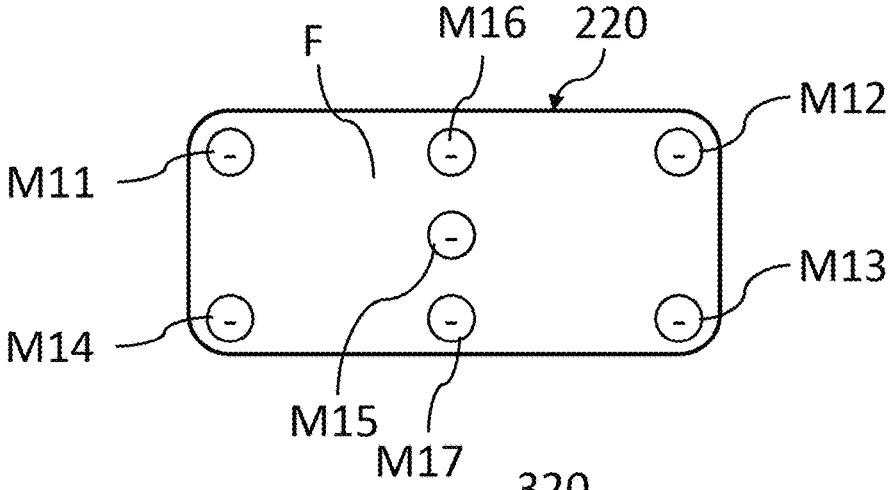
Figure 7C:
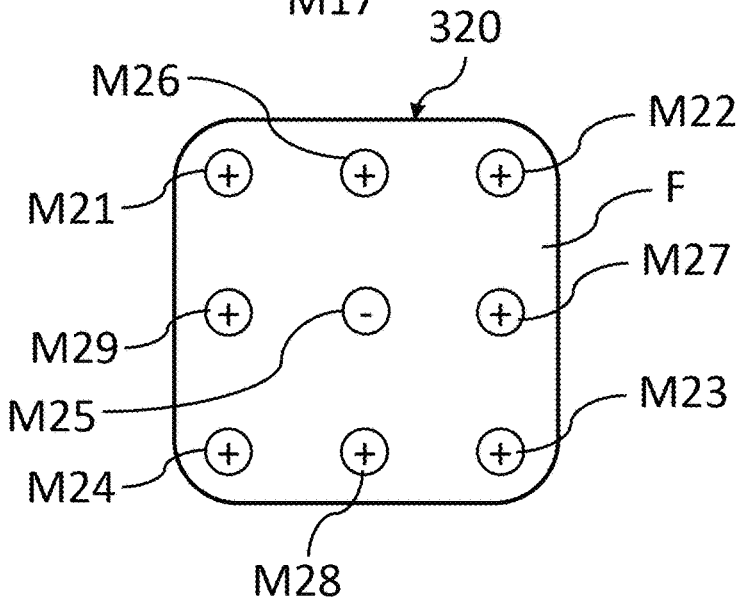

FIG. 7A exemplarily shows a schematic view of a magnet patch layer 112 of a textile fashion article according to other exemplary embodiments, FIG. 7B exemplarily shows a schematic view of a first-type magnet patch layer 220 of a magnetically attachable patch exemplarily adapted to the magnet patch layer 112 of FIG. 7A, and FIG. 7C exemplarily shows a schematic view of a second-type magnet patch layer 320 of a magnetically attachable patch exemplarily adapted to the magnet patch layer 112 of FIG. 7A.

Herein, the shapes of the patches and related magnet patch layers 220 and 320 is similar to the above exemplary embodiments of FIGS. 6A to 6C, exemplarily relating to another rectangular-shaped patch in FIG. 7B and another square-shaped patch in FIG. 7C. However, merely exemplarily, the polarities of magnets of the magnet patch layer 112 and the magnet patch layers 220 and 320 are exemplarily chosen differently.

Furthermore, while FIGS. 6A and 6B exemplarily did show rectangular-shaped or square-shaped magnet patterns, respectively, with magnets M11 to M14 and M21 to M24 arranged at corners of the respective angular shapes, the magnet patterns in FIGS. 7B and 7C further include additional magnets arranged along the circumference of the respective shape between corners.

Exemplarily, the magnet pattern of the magnet patch layer 220 further includes the magnets M16, being arranged between the corner-positioned magnets M11 and M12, and M17, being arranged between the corner-positioned magnets M14 and M15. Further exemplarily, the magnet pattern of the magnet patch layer 320 further includes the magnets M26 to M29, each of which is respectively arranged between a pair of the corner-positioned magnets M21 to M24.

In FIG. 7A, the corresponding opposite magnet patch layer 112 is shown, being configured to hold patches equipped with the magnet patch layer 220 and the magnet patch layer 320, respectively, in that the magnet patch layer 220 includes a magnet pattern arrangement with magnets of magnet patterns corresponding to the respective magnet patterns of the magnet patch layers 220 and 320. Accordingly, the corresponding opposite magnet patch layer 112 further includes magnets ME to MH, being opposite to magnets M26 to M28 of the magnets M26 to M29 of the magnet patch layer 320, and the magnets M6 and M7, being opposite to the magnets M16 and M17 of the magnet patch layer 220.

In the above, exemplarily rectangular-shaped and square-shaped patch elements have exemplarily been described. In the following, exemplarily square-shaped and triangular-shaped patch element examples shall be discussed. In general, while the above exemplary magnet pattern arrangement of the magnet patch layer 112 of a textile fashion article combines the magnet patterns for rectangular and square-shaped patches, and the below exemplary magnet pattern arrangement of the magnet patch layer 112 of a fashion article combines the magnet patterns for circular and triangle-shaped patches, other combinations are possible. For example, pattern arrangements for square shaped or rectangular patches and circle shaped patches, pattern arrangements for square shaped or rectangular patch and triangle shaped patch, etc. Other shapes are also possible. Also, pattern arrangements combining magnet patterns for three or more patch shapes of attachable patches can be provided.

Figure 8A:
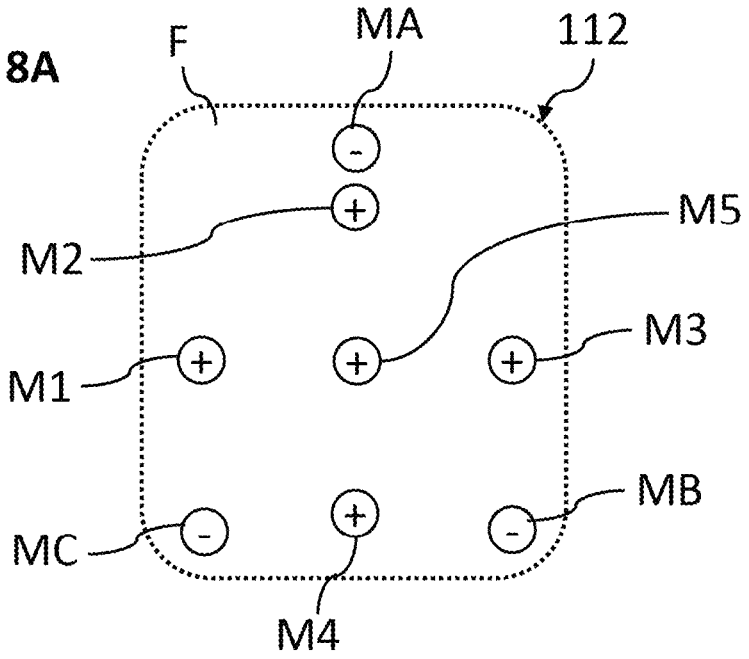

FIG. 8A exemplarily shows a schematic view of a magnet patch layer 112 of a textile fashion article according to yet another exemplary embodiments. The magnet patch layer 112 of FIG. 8A is exemplarily configured to magnetically hold (in a detachable attachment) a circular-shaped patch (or other patch) having a magnet patch layer 420 according to FIG. 8B and a triangular-shaped patch (or other patch) having a magnet patch layer 520 according to FIG. 8C.

Figure 8B:
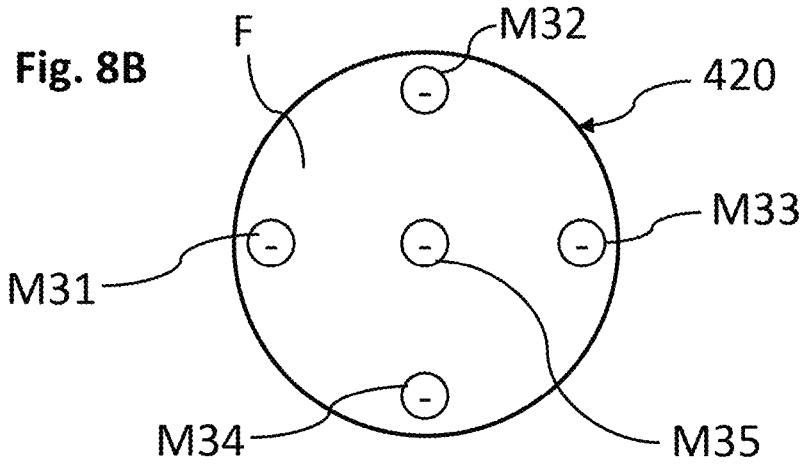
Figure 8C:
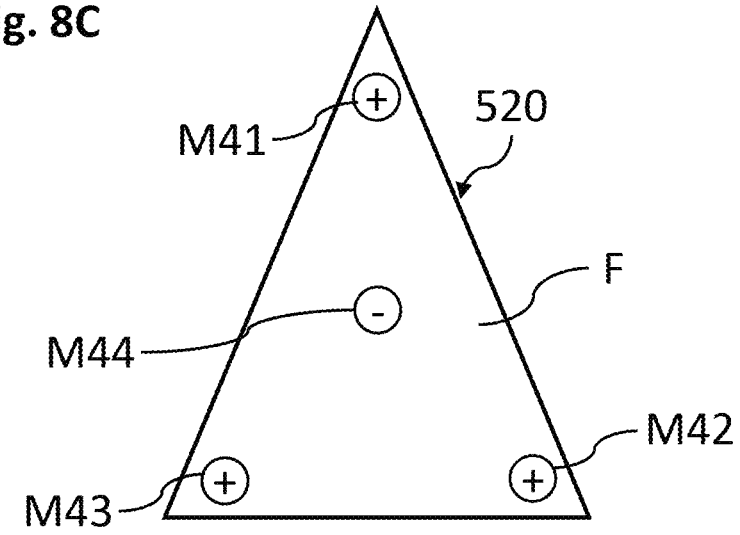

FIG. 8B exemplarily shows a schematic view of a first-type magnet patch layer 420 of a magnetically attachable circular patch exemplarily adapted to the magnet patch layer 112 of FIG. 8A, and FIG. 8C exemplarily shows a schematic view of a second-type magnet patch layer 520 of a magnetically attachable triangular patch exemplarily adapted to the magnet patch layer of FIG. 8A.

Herein, exemplarily the first-type magnet patch layer 320 includes the first-type magnet pattern including the exemplary rhombus-shaped arrangement of magnets M31 to M34 with negative polarity opposite to the corresponding positive polarity magnets M1 to M4 of the magnet pattern arrangement of the magnetic attachment portion 112 according to FIG. 8A. Also, the first-type magnet patch layer 320 includes the centered magnet M35 with negative polarity opposite to the corresponding centered negative polarity magnet M5 of the magnet pattern arrangement of the magnetic attachment portion 112 according to FIG. 8A.

Further exemplarily, the second-type magnet patch layer 520 includes the second-type magnet pattern including the exemplary triangular arrangement of magnets M41 to M43 with positive polarity opposite to the corresponding negative polarity magnets MA to MC of the magnet pattern arrangement of the magnetic attachment portion 112 according to FIG. 8A. Also, the second-type magnet patch layer 520 includes the centered magnet M44 with negative polarity opposite to the corresponding centered positive polarity magnet M5 of the magnet pattern arrangement of the magnetic attachment portion 112 according to FIG. 8A.

In the above exemplary embodiments, preferably disk-shaped permanent magnets can be used to provide the different magnet patterns. For example, the disk-shaped permanent magnets may be made from a magnetized material.

In some exemplary embodiments, the magnets, in particular disk-shaped magnets, used in the magnet pattern arrangement of the magnetic attachment portion 112 may have a larger size, e.g. a larger disk height, compared to the magnets used in the magnet pattern of the magnet patch layer(s) of the one or more patch elements. Such exemplary embodiments allow to provide a larger attractive magnetic force between the magnets, e.g. due to a larger magnetic strength of the larger sized magnets of the magnet pattern arrangement of the magnetic attachment portion 112, while keeping the size of magnets of the magnet patch layer(s) of the one or more patch elements smaller so that the thickness of the patch elements can be kept slim.

For example, permanent magnets including neodymium (high strength neodymium magnets) may be used or more preferably magnets including an alloy of neodymium, iron, and boron to form the Nd2Fe14B tetragonal crystalline structure. In preferable exemplary embodiments, the magnets may include (in weight) Nd: 29-32.5(%), Dy: 0.6-1.2 (%), Al: 0.3-0.5(%), B: 1.1-1.2(%), Fe: 63.95-68.65(%), Nb: 0.3-0.5(%), and/or Cu: 0.05-0.15(%).

While certain exemplary embodiments have been described above and shown in the accompanying drawings, it is to be understood that such embodiments are merely illustrative of and are not restrictive on the broad invention, and that the embodiments of invention are not limited to the specific constructions and arrangements shown and described, since various other changes, combinations, omissions, modifications and substitutions, in addition to those set forth in the above paragraphs, are possible. Those skilled in the art will appreciate that various adaptations, modifications, and/or combination of the just described embodiments can be configured without departing from the scope and spirit of the invention. Therefore, it is to be understood that, within the scope of the appended claims, the invention may be practiced other than as specifically described herein. For example, unless expressly stated otherwise, the steps of processes described herein may be performed in orders different from those described herein and one or more steps may be combined, split, or performed simultaneously. Those skilled in the art will also appreciate, in view of this disclosure, that different embodiments of the invention described herein may be combined to form other embodiments of the invention.

The invention claimed is:

1. A textile article or fashion article comprising:

an outer face portion, and a magnetic attachment portion configured for detachable magnetic attachment of one or more patch elements to the outer face portion, each of the patch elements including magnets that are arranged in a pre-determined pattern, respectively, wherein a first pattern corresponds to a first patch element and a second pattern corresponds to a second patch element, and wherein two or more of the magnets in the first pattern and are not included in the second pattern, and/or two or more of the magnets in the second pattern and not included in the first pattern.

2. The article according to claim 1, wherein at least one of the magnets of the magnetic attachment portion is included in the first-type pattern and the second-type pattern.

3. The article according to claim 2, wherein the at least one of the magnets of the magnetic attachment portion being included in the first-type pattern and the second-type pattern is arranged in a center portion of the pattern arrangement.

4. The article according to claim 1, wherein the first-type pattern and the second-type pattern are different.

5. The article according to claim 1, wherein the magnetically attachable patch element of the first type and the magnetically attachable patch element of the second type have different shapes and/or different sizes.

6. The article according to claim 1, wherein:

the first-type pattern has an arrangement of magnets in accordance with a size and/or shape of the magnetically attachable patch element of the first type, and/or the second-type pattern has an arrangement of magnets in accordance with a size and/or shape of the magnetically attachable patch element of the second type.

7. The article according to claim 6, wherein:

the magnetically attachable patch element of the first type has an angular shape including three or more corners and the first-type pattern has an arrangement of magnets in accordance with the angular shape of the magnetically attachable patch element of the first type and includes at least one magnet for each corner of the angular shape of the magnetically attachable patch element, and/or the magnetically attachable patch element of the second type has an angular shape including three or more corners and the second-type pattern has an arrangement of magnets in accordance with the angular shape of the magnetically attachable patch element of the second type and includes at least one magnet for each corner of the angular shape of the magnetically attachable patch element.

8. The article according to claim 1, wherein the first-type pattern has an arrangement of at least three magnets arranged around a center portion of the pattern arrangement, and/or the second-type pattern has an arrangement of at least three magnets arranged around a center portion of the pattern arrangement.

9. The article according to claim 1, wherein the two or more magnets in the first pattern and not included in the second pattern have opposite polarity compared to two or more magnets in the second pattern and are not included in the first pattern.

10. The article according to claim 1, wherein the outer face portion includes at least one textile layer, and the magnetic attachment portion is covered by the at least one textile layer.

11. A textile article or fashion article comprising an outer face portion, and a magnetic attachment portion configured for detachable magnetic attachment of one or more patch elements to the outer face portion, each of the patch elements including magnets that are arranged in a pre-determined pattern, respectively, wherein a first pattern corresponds to a first patch element and a second pattern corresponds to a second patch element, and wherein the magnets are held in their pre-determined pattern between at least two heat-pressed foils, the at least two foils being embedded between at least two layers of fabric.

12. A magnetically attachable patch element including:

a front layer including fabric;

a back layer including fabric; and a magnet patch layer arranged between the front and back layers, the magnet patch layer including a magnets arranged according to a pre-determined pattern, wherein the magnetically attachable patch element is configured for detachable magnetic attachment to an outer face portion of a textile article, and wherein the magnets are held in the pre-determined pattern between at least two heat-pressed foils, the at least two foils being embedded between at least two layers of fabric.

13. A magnetically attachable patch element including:

a front layer including fabric;

a back layer including fabric; and a magnet patch layer arranged between the front and back layers, the magnet patch layer including a plurality of magnets that are arranged in a first pattern and being configured for detachable magnetic attachment to an outer face portion of a textile article, and wherein two or more of the plurality of magnets in the first pattern and are not included in a second pattern that corresponds to a second patch element that includes magnets, and/or two or more of the magnets in the second pattern and not included in the first pattern.

* * * * *